United States Patent [19]

Bolling et al.

[11] Patent Number: 4,946,289

[45] Date of Patent: Aug. 7, 1990

[54] RECLOSABLE OPEN MOUTH BAG

[75] Inventors: Robert W. Bolling; James R. Sanders, both of Savannah, Ga.

[73] Assignee: Union Camp Corporation, Wayne, N.J.

[21] Appl. No.: 12,146

[22] Filed: Feb. 6, 1987

[51] Int. Cl.[5] ..... B65D 33/18; B65D 33/16

[52] U.S. Cl. ..... 383/61; 206/616; 383/86

[58] Field of Search ..... 206/616, 618, 632; 383/61, 85, 86, 63, 65

[56] References Cited

U.S. PATENT DOCUMENTS

| | | | |
|---|---|---|---|
| 2,071,745 | 2/1937 | Higginbottom | 383/61 |
| 2,345,434 | 3/1944 | Sterling | 383/92 |
| 3,215,335 | 11/1965 | Turpin | 206/618 |
| 3,337,118 | 8/1967 | Friduss | 383/92 |
| 3,446,420 | 5/1969 | Rinecker | 229/80 |
| 3,557,853 | 1/1971 | Jones | 383/86 |
| 3,807,626 | 4/1974 | Goodrich | 383/85 |
| 3,850,366 | 11/1974 | Saito | 383/85 |
| 4,131,195 | 12/1978 | Worrell, Sr. | 383/61 |
| 4,337,889 | 7/1982 | Moertel | 383/61 |
| 4,471,875 | 9/1984 | Hain et al. | 383/85 |
| 4,557,385 | 12/1985 | Robinson | 206/610 |
| 4,567,987 | 2/1986 | Lepisto et al. | 206/618 |
| 4,572,377 | 2/1986 | Beckett | 206/632 |
| 4,691,370 | 9/1987 | MacFee | 383/84 |
| 4,824,261 | 4/1989 | Provost | 383/81 |

FOREIGN PATENT DOCUMENTS

| | | | |
|---|---|---|---|
| 1380727 | 1/1975 | United Kingdom | 229/71 |

*Primary Examiner*—Stephen P. Garbe
*Attorney, Agent, or Firm*—Edward J. Sites

[57] ABSTRACT

In an open mouth bag, in which a primary closure is formed by folding down a lip of the rear panel and securing it to the front panel with means to release the lip from the front panel, an improved secondary closure of a reclosable fastening tape which can be repeatedly opened and reclosed after the lip has been released from the primary closure.

2 Claims, 5 Drawing Sheets

RECLOSABLE OPEN MOUTH BAG

BACKGROUND OF THE INVENTION

1. Field of the Invention

This invention relates to bags and more particularly to open mouth bags provided with a first pasted or stitched closure which can be released by a tear strip or tape or other means and a second reclosable means for repeatedly opening and reclosing the bag after the first closure has been released.

2. Brief Description of the Prior Art

The prior art includes U.S. patents which show bags and containers with various forms of closures, tear strips and reclosable features but none disclose the construction of the present invention.

U.S. Pat. No. 3,599,859 shows a hot seal on the outside of a tear strip next to a resealable tab, but on the top of a box, not a bag.

U.S. Pat. No. 4,337,889 shows a reclosable slide fastener on a bag, but there is no tear strip and it is doubtful that there could be a suggestion of an overlap and a tear strip.

A slide fastener opening is provided in U.S. Pat. No. 4,241,865, but at the end of a bag, not as part of a folded over seal.

A permanently tacky resealable flap with an adhesive patch is provided in U.S. Pat. No. 4,015,771, but there is no tear strip and the tacky adhesive is not a hook and loop type fastener.

U.S. Pat. No. 4,335,817 has a tear strip which covers a reclosable slide fastener, but the fastener is not in the sealed end of the bag.

Adhesive strips and a tear strip are shown in the top of a gussetted bag in U.S. Pat. No. 4,567,987 but the adhesive is not resealable and the tear strip is inside the complimentary adhesive strips rather than outside the complimentary adhesive strips.

U.S. Pat. No. 3,123,479 shows a reclosable bag with a breakable seal, but the bag and the reclosable feature are not related to the present invention.

U.S. Pat. Nos. 3,557,853, 4,418,733 and 4,421,150 describe hook and loop types of fabric closures but are not otherwise related to the present invention.

SUMMARY OF THE INVENTION

In an open mouth bag with the rear panel having a lip extending above the mouth of the bag adapted to be folded along a fold line at one end of the bag and secured to the face of the front panel to form a primary closure for the end of the bag, said closure being provided with means for releasing the lip from the front panel, a secondary closure at the said end of the bag comprising a hook and loop type of fabric fastening tape having mating strips secured to the lip of the rear panel and to the face of the front panel, the said strips being superimposed when the lip is folded over to form the primary closure, the secondary closure being positioned to secure the lip to the front panel after the primary closure has been released, whereby the secondary closure can be repeatedly opened and reclosed after the lip has been released from the primary closure.

DESCRIPTION OF THE PREFERRED EMBODIMENT

Figure 1:
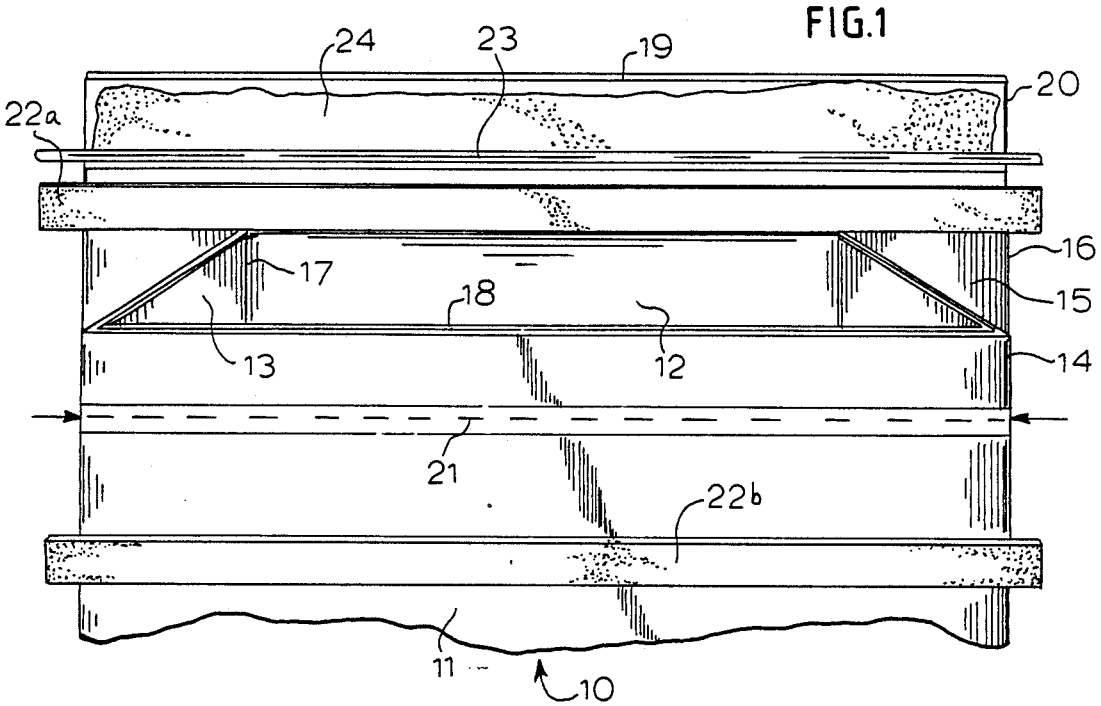
FIG. 1 is a front elevational view of a broken away end portion of a reclosable pinch type open mouth bag constructed in accordance with the present invention.

Referring to the drawings, there is shown in FIG. 1 one end of a multiple pinch type open mouth bag 10 which includes front and rear panels 11 and 12 which are disposed in generally parallel relationship to one another. A first front gusset panel 13 is articulated to a side of the front panel 11 along fold line 14. A first rear gusset panel 15 is articulated to a side of the rear panel 12 along fold line 16. The first front gusset panel 13 and first rear gusset panel 15 are articulated to one another along fold line 17. Fold line 17 extends generally parallel to fold lines 14 and 16. There are duplicate panels and fold lines forming the gusset on the other side of the front and rear panels.

The front panel 11 is characterized by a top edge 18 which extends perpendicularly between the opposed sides of the front panel. The rear panel 12 is further characterized by a top edge 19 which is generally parallel to but spaced above the top edge 18 of the front panel. This provides an extension or lip 20 of the rear panel which can be folded over along a fold line 21 onto the front panel to form a closure for the end of the bag.

A strip **22*a* of fabric fastening tape 22 (mating hook and loop) is applied to the lip below and spaced from the top edge 19 of the rear panel 12. The tape 22** may comprise a velvet type of fastener fabric, such as is described in U.S. Pat. No. 2,717,437, incorporated herein by reference thereto. These fasteners are commercially available under the trademark Velcro. Velcro fasteners are a hook and loop type of fastener which may comprise two strips of fabric or components. One strip (which may be strip 22*a* or 22*b* described hereinafter) may be referred to as the "pile component" and is fabricated from a pile material. The pile material may be densely matted collection of strand loops of a synthetic resin fiber. The second component (which is the other of the strips 22*a* or 22*b*) is the hook component, which may be a twill fabric, having projecting fiber ends, hooked at the end. When the two components are brought together, the hook members of the hook component enter the pile and the hooks will thus become engaged in or will grip the loops of the pile and effect the firm coupling together of the components. Release of the cooperating interlocked elements of the components is effected by grasping the free end of one of the components and pulling outwardly on the same from the mating component. This will cause the hook members and the loops of the pile to disengage from interlock.

The tape 22*a* extends across the lip parallel to the top edge 19. Directly above the tape strip 22*a* a tear strip 23 is applied to the lip 20. Above the tear strip 23 to the top edge 19 of the lip 20 a hot melt or other suitable adhesive 24 is applied to the lip to serve as the primary closure. The tear strip 23 is affixed to the lip 20 generally parallel to the top edge 19 and extends across the lip 20 with one end extending beyond the panel 12 a sufficient distance to enable the tear strip to be easily grasped between the end of the strip and the side of the bag. The tear strip may be string, a hot melt string or other strip known to the person skilled in the art. The tear strip must be of sufficient tensile strength to withstand the forces placed thereon as the tear strip is urged through the material from which the bag 10 is formed.

Figure 2:
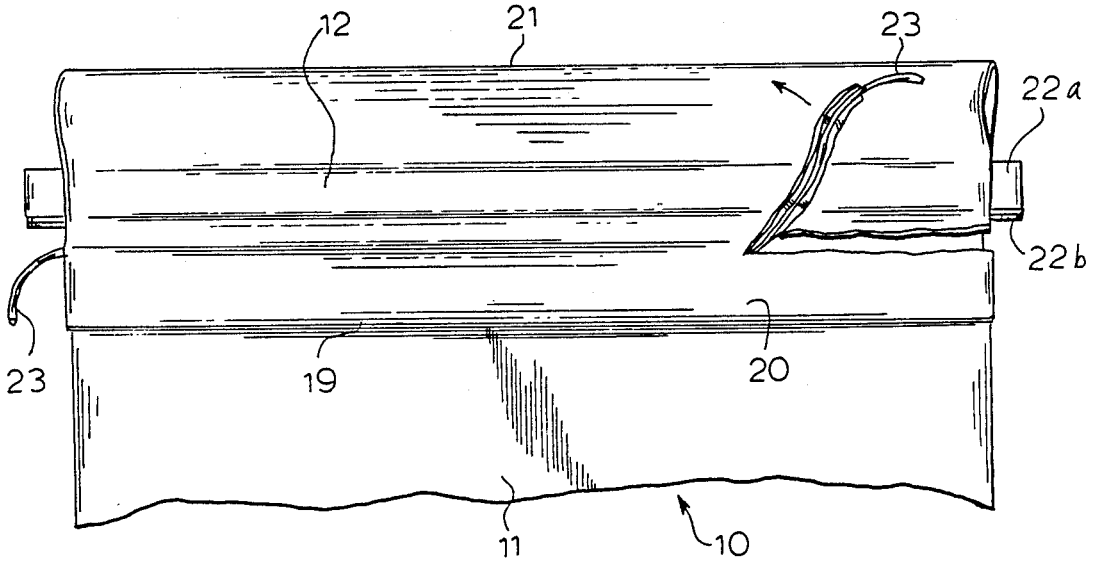
FIG. 2 is a view similar to that of FIG. 1 showing the lip of the rear panel of the bag of FIG. 1 folded over and secured to the front panel with the tear string partially pulled.

The other mating strip 22*b* of fastening tape 22 is applied to the front panel 11 in a position such that the strips 22*a*, 22*b* will be superimposed when the lip 20 is folded along fold line 21 and secured to the front panel by the adhesive (FIG. 2). The tape 22 made of strips 22*a* and 22*b* serves as the secondary closure.

The closures described are applied to the bag 10 by the bag manufacturer, who ships such bag to the customer with the other end of the bag open. The customer fills the bag through the open end and then closes and seals such end. The filled bag is shipped to the ultimate user of the product in the bag. Bags of this type are necessary for shipping and storing products which must be protected against sifting or leaking of the material packaged in the bag. The ultimate user of the product can open the bag by pulling on the tear strip 23 (FIGS. 2 and 3) thereby at least partly severing the folded top portion of the bag. The fastening tape can be pulled apart to gain complete access to the contents of the bag. After some of the contents of the bag have been removed, the lip 20 can be folded over the front panel 11 and the mating strips 22*a*, 22*b* of tape 22 can be pressed together to reclose the bag. Thus the closure permits repeatedly opening and reclosing the bag. This closure is particularly suitable for bags used for pet food products.

Figure 9:
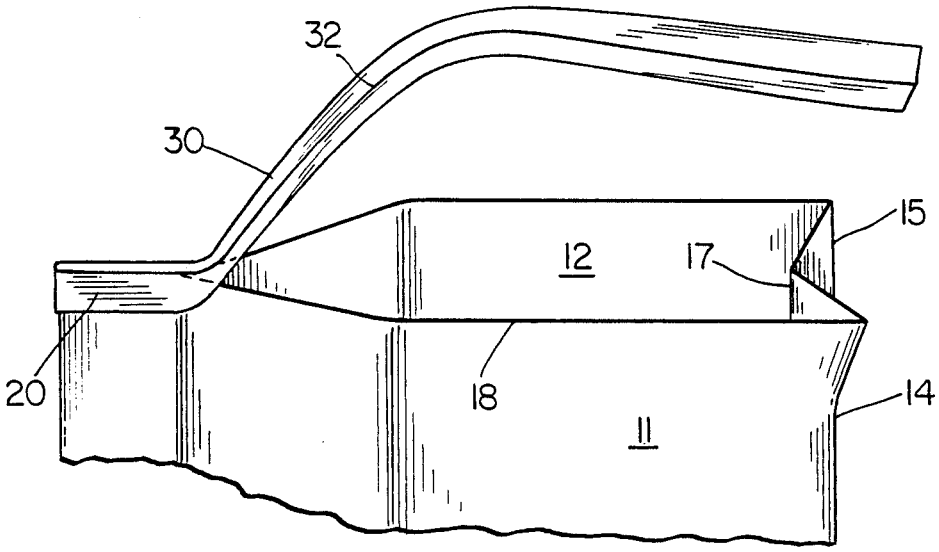
FIG. 9 is a view of an alternate primary closure means employed in the bags of the invention.

It will be understood that this same form of closure can be applied to an open mouth bag where the top edges of the front and rear panels are the same height and not spaced above and below each other. In such case as shown in FIG. 9 a fold over tape 30 along fold 32 can be affixed to the rear panel 12 to serve as an extension or lip 20 to be folded over as heretofore described.

Since the primary closure can be made with a line of sewing in place of the line of adhesive, the foldover tape 30 described in the preceding paragraph can be used with such sewing. Where sewing is used, it is done with rip stitching which can be pulled to unravel the stitching. In such case the rip stitching takes the place of the tear strip 23 described above, but the lip 10 remains completely intact and is not severed.

Figure 10:
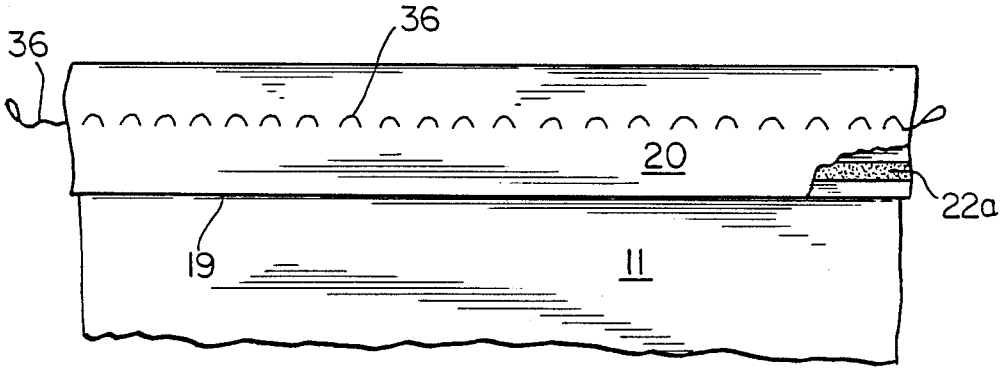
FIG. 10 is a view as in FIG. 2, of an alternate means of securing the primary closure in the bags of the invention.
Figure 11:
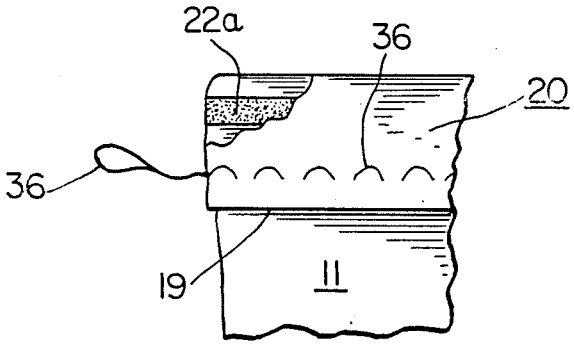
FIG. 11 is a partial view as seen in FIG. 10, of still another construction of a bag of the invention.

FIG. 10 is a view as in FIG. 2, of an embodiment bag 34 wherein the primary closure includes sewing instead of adhesive to secure closure. If the primary closure, heretofore described for the pinch bottom bag, is sewing instead of adhesive, the hot melt or other type of adhesive 24, and the tear string 23 are dispensed with. After the lip 20 is sewn to the front panel 11 by a line of rip stitching 36 either above (see FIG. 11) or below (see FIG. 10) the fastening tape 12. In either case when the rip stitching 36 is unraveled, the primary closure releases the lip 20 from the front panel 11. Thus the lip 20 is secured to the front panel 11 by the secondary closure of tape 22 which can be repeatedly opened and reclosed.

Figure 4:
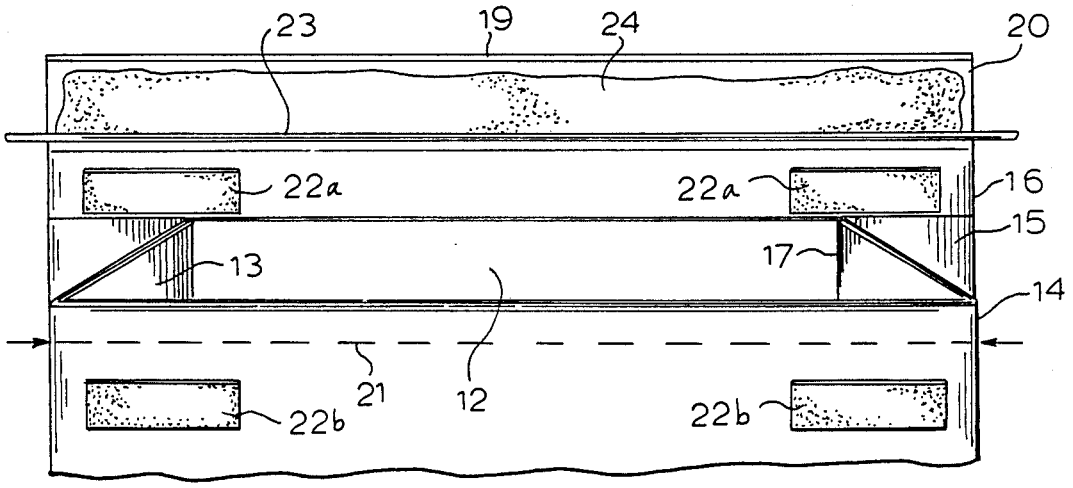
FIG. 4 is a front elevational view of a broken away end portion of a reclosable single wall open mouth bag with only patches of tape to open and reclose the bag.

FIG. 4 shows a modified form of secondary closure in which the continuous reclosable fastening strips running completely across the panels are replaced by a plurality of strips which are not connected to each other. In other respects the closures are the same as heretofore described.

Figure 5:
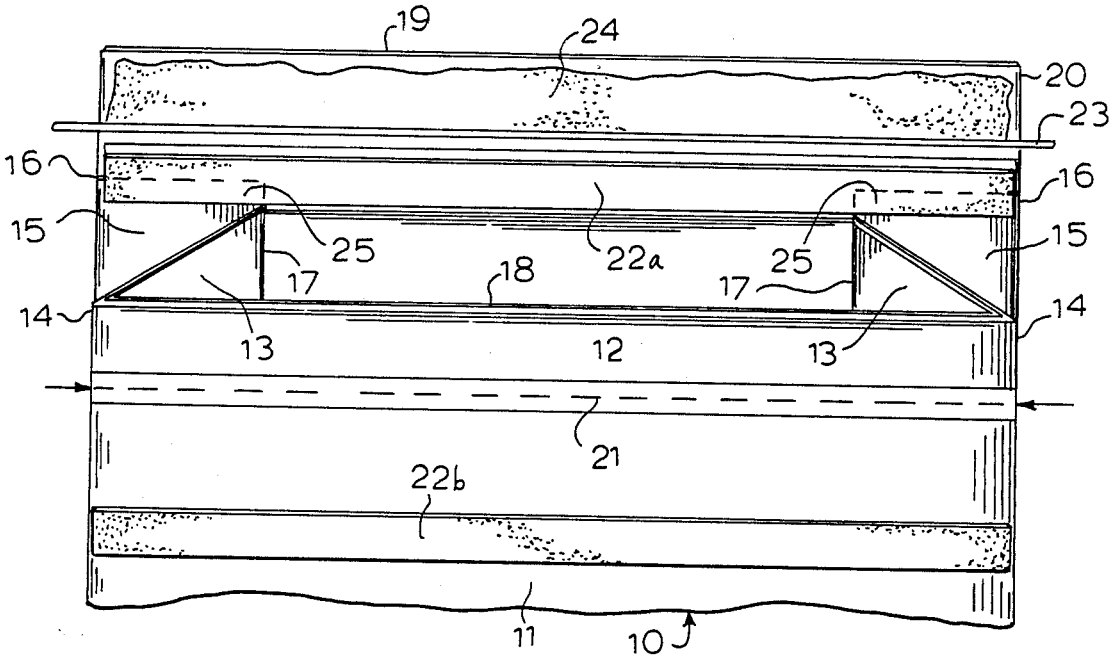
FIG. 5 is a view similar to that of FIG. 1 showing a reclosable pinch type open mouth bag similar to that of FIG. 1 in which the construction is modified by extending the rear gusset panels upward so that the extended portion can be secured under the adjacent closure tape.
Figure 6:
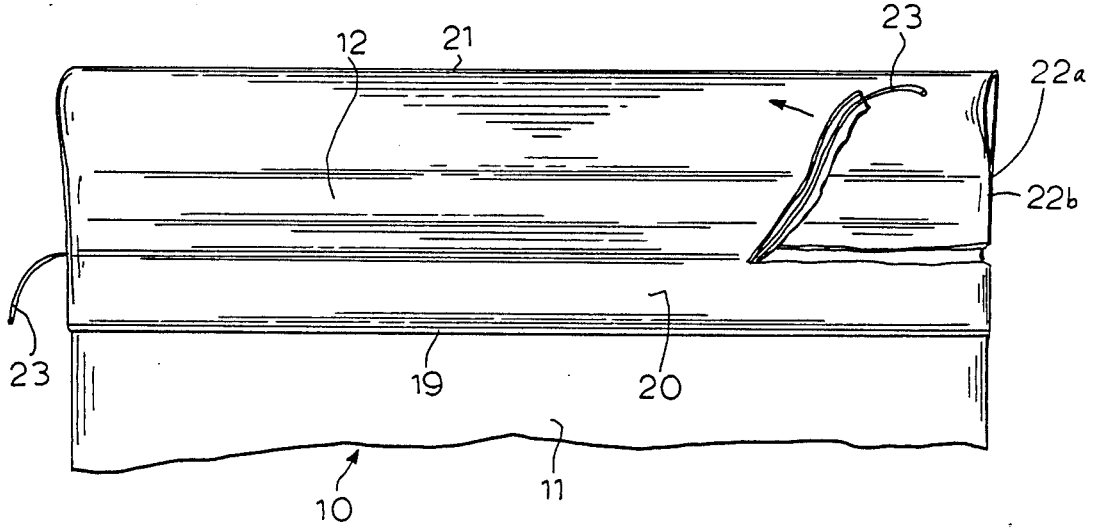
FIG. 6 is a view similar to that of FIG. 5 showing the lip to the rear panel of the bag of FIG. 5 folded over and secured to the front panel with the tear string partially pulled.
Figure 7:
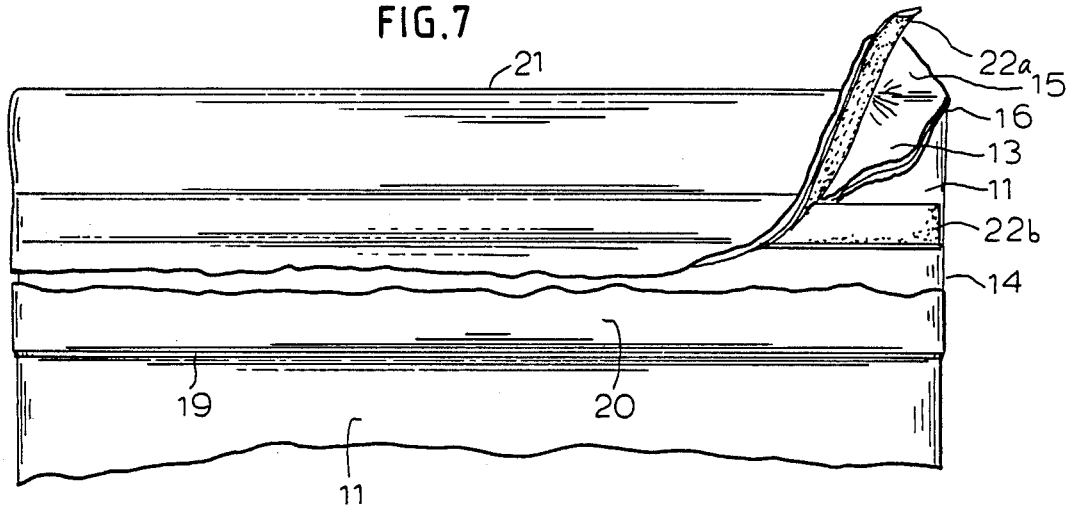
FIG. 7 is a view similar to that of FIG. 5 showing the end of the bag after pulling the tear strip with the bag only closed by the hook and loop type of closure tape.

It has been found that in the construction of FIG. 1, where both the front and rear gusset panels are free, it is difficult to tuck such panels into proper alignment after some of the product has been removed from the bag and the bag is to be reclosed and the product will leak out of the popped out gussets. To overcome this possible problem, the rear gusset panels are extended upwardly so that they can be sealed in place under the closure tape 22*a* (FIG. 5). The extended portions 25 of the rear gusset panels are bonded under the closure tape 22*a* thus holding the rear gusset panels in place, but allowing the front gusset panels to hinge outward when the bag is open and the product is being removed. This serves to make the gussets tuck in naturally for reclosure. Otherwise with both gusset panels free, it is difficult to tuck them in after opening. The opening of the primary closure shown in FIG. 6 and the reclosure shown in FIG. 7 are similar to those shown in FIGS. 2 and 3.

Figure 8:
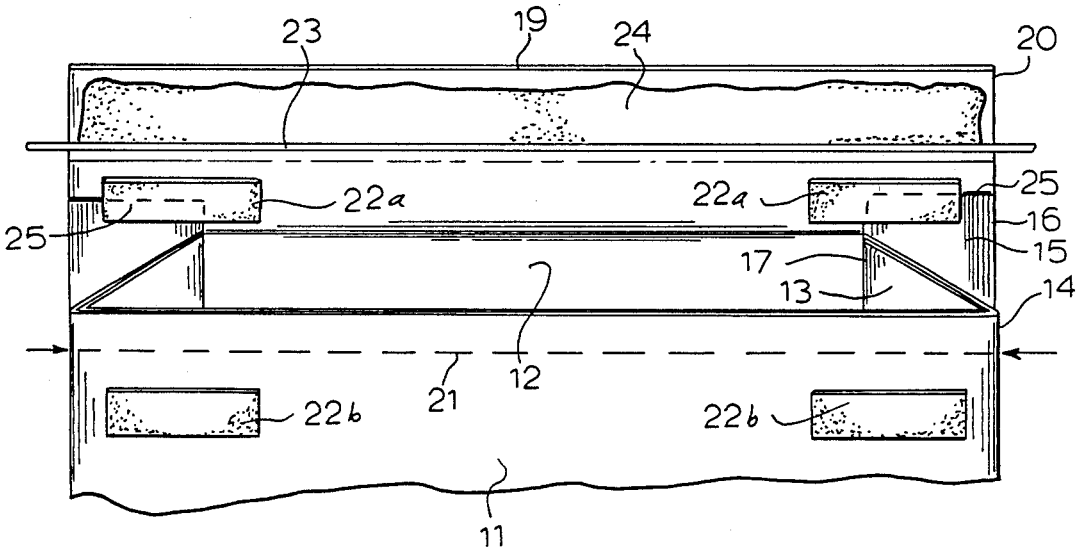
FIG. 8 is a front elevational view of a broken away end portion of a reclosable single wall open mouth bag with only patches of tape to open and reclose the bag and the extended rear gusset panels shown in FIG. 5 secured under the adjacent patches of tape.

FIG. 8 shows the construction for the extended rear gusset panels where only patches of tape are used as the secondary closure to open and reclose the bag. Portions of the extensions 25 of the rear gusset panels 15 are bonded under the patches 22*a* of the closure tape 22. This serves to hold the rear gusset panels in place against the rear panel as heretofore described for FIG. 5.

Figure 3:
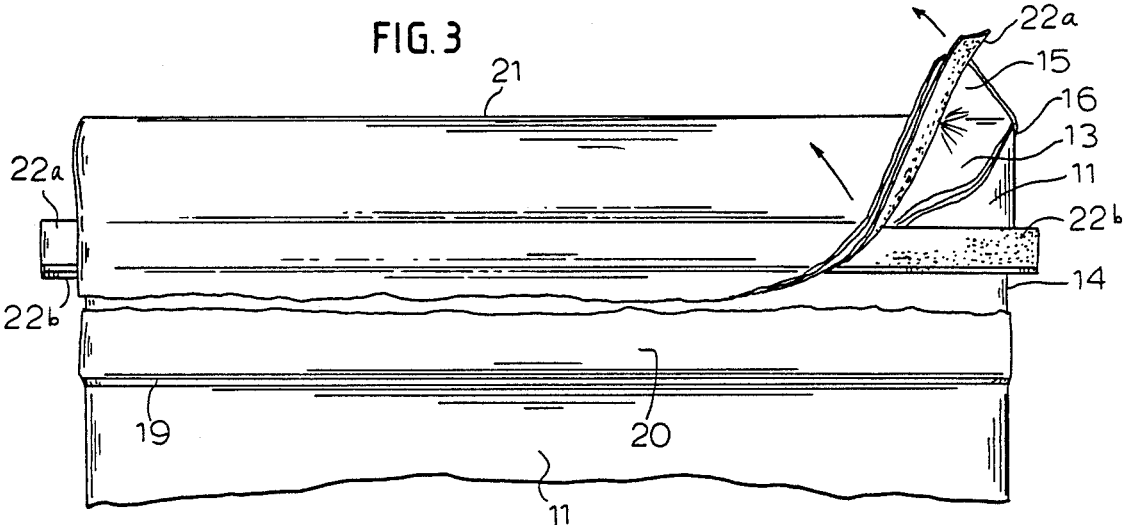
FIG. 3 is a view similar to that of FIG. 2 showing the end of the bag after pulling the tear strip with the bag only closed by the hook and loop type of closure tape.

In FIGS. 1–3 inclusive, the secondary closure tape 22 extends beyond the side edges of the bag. In FIGS. 5–7 inclusive, the secondary closure tape extends approximately to the side edges of the bag. It will be understood that such tape can be any length in any of the constructions shown.

Release of the cooperating interlocked elements of the components of the secondary closure tape can be effected by grasping the tape at either end, the tape in the central area of the tape, or the lip of the bag to which the tape is attached at either end or in the central area of the lip.

It will be understood that the closures can be applied to any single wall or multiwall open mouth bag, with or without gussets.

Those skilled in the art will appreciate that many variations of the above described embodiment of the invention may be made without departing from the spirit and scope of the invention.

What is claimed is:

1. In an open mouth bag including front and rear panels disposed in generally parallel relationship to one another and interconnected along their longitudinal edges by means of gussets, the rear panel being provided with a lip extending above the mouth of the bag, said rear panel being foldable along a fold line on the rear panel, positioned below the lip and the mouth of the bag, and securable to the face of the front panel; and means for securing the lip to the face of the front panel to form a primary closure of said open mouth of the bag, said lip being provided with means for unsecuring at least part of the lip from the front panel; an improved secondary closure at said open mouth of the bag in cooperation with said primary closure, comprising:

a fastening tape with mating hook and loop strips, one strip being secured to the lip of the rear panel above said gussets and the other mating strip being secured to the face of the front panel in a position so that the strips will be superimposed when the lip is folded over, the secondary closure being positioned to secure the lip to the front panel after the lip has been unsecured;

said gussets comprising front and rear gusset panels articulated along central fold lines, the rear gusset panels being extended above the mouth of the bag and secured under the fastening tape strips to hold the rear gusset panels in place against the rear panel of the bag;

whereby the secondary closure can be repeatedly opened and reclosed after the lip has been unsecured.

2. The bag of claim 1 in which the fastening tape is non-continuous with a strip secured to the lip of the rear panel of the bag positioned above each gusset area and the rear gusset panels articulated along central fold lines, said rear gusset panels being extended above the mouth of the bag and secured under the fastening tape to hold the rear gusset panels in place against the rear panel of the bag.

* * * * *